US008939300B2

(12) United States Patent
Wilt et al.

(10) Patent No.: US 8,939,300 B2
(45) Date of Patent: Jan. 27, 2015

(54) FRICTION/ELASTOMERIC DRAFT GEAR

(75) Inventors: Donald E. Wilt, Batavia, IL (US); Keith A. Salis, Clare, IL (US); Rosie Galindo, Chicago, IL (US); Robert J. Pokorski, St. Charles, IL (US); Kris C. Jurasek, Sugar Grove, IL (US); William P. O'Donnell, Batavia, IL (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 13/261,317

(22) PCT Filed: Sep. 17, 2010

(86) PCT No.: PCT/US2010/002537

§ 371 (c)(1), (2), (4) Date: Jun. 8, 2012

(87) PCT Pub. No.: WO2012/036657

PCT Pub. Date: Mar. 22, 2012

(65) Prior Publication Data

US 2013/0168346 A1 Jul. 4, 2013

(51) Int. Cl.

| | |
|---|---|
| ***B61G 9/00*** | (2006.01) |
| ***B61G 11/00*** | (2006.01) |
| ***B61G 9/06*** | (2006.01) |

(52) U.S. Cl.

CPC ..... *B61G 9/06* (2013.01)
USPC ..... 213/22; 213/31

(58) Field of Classification Search

CPC ..... B61G 9/00; B61G 9/02; B61G 9/025; B61G 9/04; B61G 9/045; B61G 9/06; B61G 11/00; B61G 11/02; B61G 11/08
USPC ..... 213/7, 9, 22–24, 31–34, 40 R
See application file for complete search history.

(56) References Cited

U.S. PATENT DOCUMENTS

| | | | |
|---|---|---|---|
| 4,198,037 | A | 4/1980 | Anderson |
| 4,576,295 | A | 3/1986 | Carlstedt |
| 4,735,328 | A | 4/1988 | Carlstedt |
| 4,960,215 | A | 10/1990 | Carlstedt |
| 5,104,101 | A | 4/1992 | Anderson et al. |

(Continued)

OTHER PUBLICATIONS

Iinternational Searching Authority; International Search Report issued in connection with International Application No. PCT/US2010/002537;Nov. 5, 2010; 2 pages.

(Continued)

*Primary Examiner* — R. J. McCarry, Jr.
(74) *Attorney, Agent, or Firm* — Law Office of John W. Harbst

(57) ABSTRACT

A friction/elastomeric draft gear having a housing, a spring assembly arranged within the housing, and a friction clutch assembly having a wedge member and defining first sliding friction surface disposed at an angle θ relative to a longitudinal axis of the draft gear and a second friction surface disposed at an angle β relative to a longitudinal axis of the draft gear. The spring assembly is designed in combination with the angles θ and β of the first and second friction sliding surfaces relative to the longitudinal axis such that the draft gear consistently and repeatedly withstands between about 100 KJ and 130 KJ of energy imparted at less than three meganewtons over a range of travel of the wedge member in an inward axial direction relative to the draft gear housing not exceeding 120 mm.

25 Claims, 8 Drawing Sheets

(56) References Cited

U.S. PATENT DOCUMENTS

| | | | | |
|---|---|---|---|---|
| 5,351,844 | A | 10/1994 | Carlstedt | |
| 6,478,173 | B2 * | 11/2002 | Carlstedt | 213/32 C |
| 6,488,162 | B1 | 12/2002 | Carlstedt | |
| 6,520,360 | B1 | 2/2003 | Withall et al. | |
| 6,792,871 | B2 | 9/2004 | O'Donnell et al. | |
| 6,796,448 | B1 | 9/2004 | Wilt et al. | |
| 6,862,999 | B2 | 3/2005 | O'Donnell et al. | |
| 6,877,623 | B2 | 4/2005 | Salis | |
| 7,044,061 | B2 | 5/2006 | O'Donnell et al. | |
| 7,624,884 | B2 | 12/2009 | Palermo et al. | |
| 2002/0070189 | A1 | 6/2002 | Barker et al. | |
| 2010/0059470 | A1 | 3/2010 | Carlstedt et al. | |

OTHER PUBLICATIONS

International Searching Authority; Written Opinion issued in connection with International Application No. PCT/US2010/002537; Nov. 5, 2010; 6 pages.

Ukrainian Patent Office; Office Action issued by the Ukrainian Patent Office in connection with Ukrainian patent application Serial No. a201207219; 8 pages; Dec. 12, 2013.

English language translation of Cite No. DA.

* cited by examiner

FIG. 7
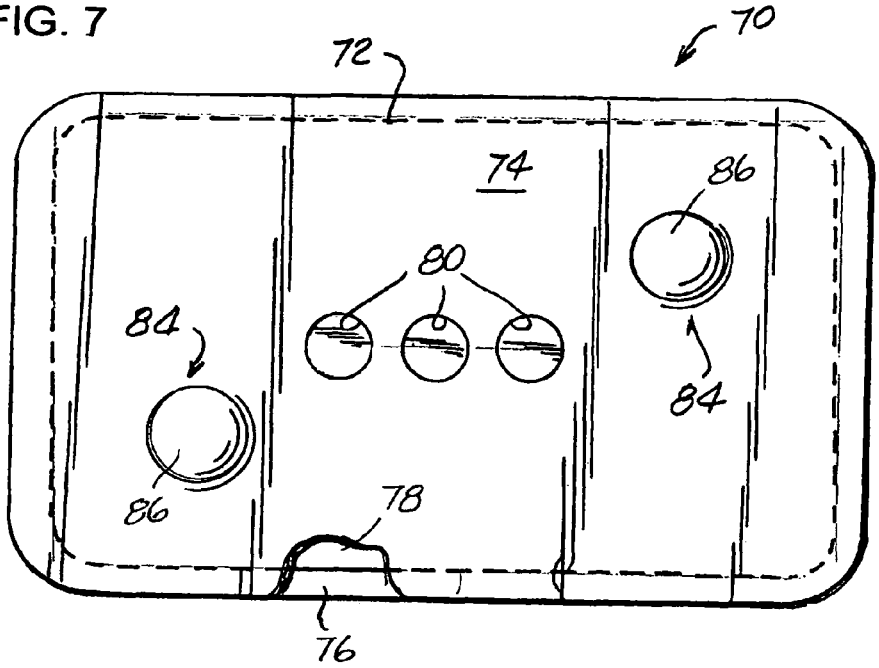
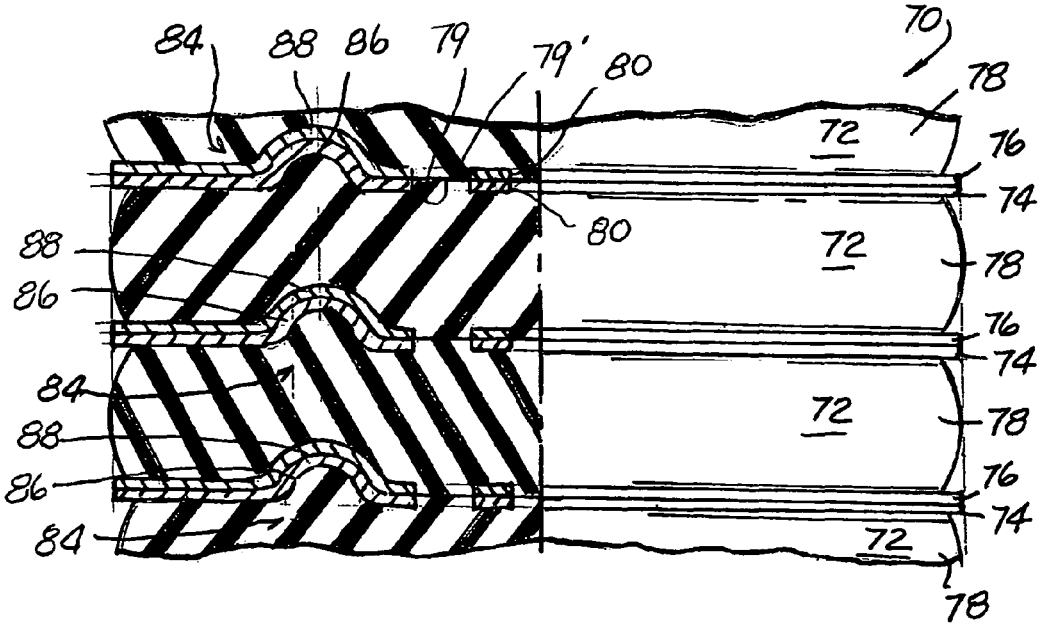
FIG. 6

FRICTION/ELASTOMERIC DRAFT GEAR

FIELD OF THE INVENTION

This invention disclosure generally relates to railcar draft gears and, more specifically, to a railcar draft gear specifically designed to consistently and repeatedly withstand up to about 130 KJ of energy imparted to said draft gear at less than three meganewtons while having a wedge member move in an inward axial direction ranging less than about 120 mm relative to an open end of the draft gear.

BACKGROUND

Coupler systems for modern railroad cars typically include a draft gear to cushion and absorb forces placed on the system during car operation. In conventional draft gears, draft forces impinging upon a wedge member extending from an open end of a draft gear housing are dissipated in the draft gear housing through a friction clutch assembly. The open end of the draft gear housing has a series of inwardly tapered friction surfaces such that as the wedge member is forced inwardly of the draft gear housing, in response to draft forces acting thereon, friction members forming part of the friction clutch assembly are also moved axially inward of the housing and radially outward by the wedge member. As the wedge member moves axially inward relative to the housing the wedge member provides a radially directed force against the friction members whereby increasing the friction force between the friction members and the housing. Moreover, inner ends of the friction members abut against a follower or spring seat. The spring seat is resiliently biased against the friction members by a spring assembly which resists axial inward movement of the friction members and wedge member.

While conventional draft gears have high shock absorbing capacities and capabilities, they tend to transmit high magnitude of force to the railcar structure during a work cycle. Of course, transmitting a high magnitude of force to the railcar structure can result in damages to the goods being carried by the railcar.

Thus, there is continuing need and desire for a draft gear having the capability and capacity for absorbing extremely large forces during operation of the railcar while offering improved cushioning between the draft gear and the railcar structure.

SUMMARY

In view of the above, and in accordance with one aspect, there is provided a friction/elastomeric draft gear including a hollow metal housing open at a first end and closed toward the second end thereof. The housing defines a longitudinal axis for the draft gear and has a series of tapered longitudinally extended inner surfaces opening to and extending from the open end of the housing. The draft gear housing has two pairs of joined and generally parallel walls extending from the closed end toward the open end such that a hollow chamber having a generally rectangular cross-sectional configuration is defined by and for a major portion of the length housing and opens to the open end thereof. A series of friction members are equally spaced about the longitudinal axis at the first end of the housing. Each friction member has axially spaced first and second ends and an outer surface extending therebetween. The outer surface on each friction member is operably associated with one of the tapered longitudinally extended inner surfaces on the housing so as to define a first angled friction sliding surface therebetween. A wedge member is arranged from axial movement relative to the open end of the housing. The wedge member defines a series of outer tapered surfaces equally spaced about the longitudinal axis of the housing and equal in number to the number of friction members. Each outer tapered surface on the wedge member is operably associated with an inner surface on each friction member so as to define a second angled friction sliding surface therebetween and such that the wedge member causes the friction members to move radially outward upon movement of the wedge member inwardly of the housing. A spring seat is arranged within the hollow chamber of the draft gear housing and extends generally normal to the longitudinal axis of the draft gear. The spring seat is arranged in operable engagement with the second end of each friction member.

A spring assembly is disposed in the hollow chamber of the draft gear between the closed end of the housing and the spring seat for storing, dissipating and returning energy imparted to the draft gear. The spring assembly comprises a axial stack of individual elastomeric springs. Each individual elastomeric spring includes an elastomeric pad having a generally rectangular shape approximating the cross-sectional configuration of the housing chamber whereby optimizing the capability of the spring assembly to store, dissipate and return energy imparted to the draft gear during its operation. To enhance the capability and capacity for absorbing extremely large forces during operation of the railcar while offering improved cushioning between the draft gear and the railcar structure, the spring assembly is configured to function in operable combination with the disposition of the first and second friction sliding surfaces relative to the longitudinal axis of the draft gear such that said draft gear consistently and repeatedly withstands 100 KJ of energy imparted to the draft gear while not exceeding q force level of two meganewtons over a range of travel of the wedge member in an inward axial direction relative to the housing of about 90 mm.

Preferably, each individual elastomeric spring includes structure for maintaining axially adjacent elastomeric pads of the spring assembly in generally axially aligned relation relative to each other.

In one form, at least one wall of the draft gear housing defines an opening through which the individual elastomeric springs can be moved into the hollow chamber defined by the draft gear housing. Preferably, the first friction sliding surface between the outer surface of each friction member and one of the tapered longitudinally extended inner surfaces on the draft gear housing is disposed at an angle ranging between about 1.7° and about 2° relative to the longitudinal axis of the draft gear. In another form, the second friction sliding surface between each outer tapered surface on the wedge member and the inner surface on each friction member is disposed at an angle ranging between about 32° and about 45° relative to the longitudinal axis of the draft gear. In a preferred embodiment, each friction member further includes structure arranged in operable combination with the spring seat for maintaining each friction member in operative relationship with the wedge during operation of the draft gear.

In a preferred form, the elastomeric pad of each individual elastomeric spring is formed from a polyester material having a Shore D hardness ranging between about 40 and 60 and an elastic strain to plastic strain ratio greater than 1.5 to 1. The elastomeric pad of each individual elastomeric spring furthermore preferably includes a metal plate on opposed planar sides of each elastomeric pad. Preferably, each metal plate includes structure interengaging with similar structure of an adjacent elastomeric spring for maintaining the individual elastomeric springs in generally aligned and stacked relation relative to each other.

According to another aspect, there is provided a friction/elastomeric draft gear for a railcar including an axially elongated metallic housing having a closed end, an open end. The housing defines a longitudinal axis for the draft gear. The housing further includes two pairs of joined sidewalls extending generally from the closed end for major lengthwise distance between the ends so as to define a hollow chamber having a generally rectangular cross-sectional configuration. A friction clutch assembly is provided for absorbing axial impacts directed against the draft gear. The friction clutch assembly includes a plurality of friction members, with each friction member, in combination with the open end of the draft gear housing, defining a first friction surface arranged at an angle θ relative to the longitudinal axis of the draft gear. The friction clutch assembly further includes an actuator having a plurality of angled surfaces and axially extending beyond the open end of the housing for receiving energy directed axially to the draft gear. Each angled surface on the actuator is arranged in sliding friction engagement with an inner surface on each friction member and defines a second friction surface disposed at an angle β relative to the longitudinal axis of the draft gear. A spring seat is arranged in operable combination with the plurality of friction members.

An elastomeric spring assembly is centered and slidably fitted within the rectangular hollow chamber of the housing. The spring assembly includes a series of axially stacked individual units between the closed end of the housing and the spring seat for absorbing, dissipating and returning energy imparted to the actuator during operation of the draft gear. Each unit includes a, an elastomeric spring having, in plan, a generally rectangular configuration approximating the cross-sectional configuration of the hollow chamber of said housing whereby optimizing the capability of the spring assembly to store, dissipate and return energy imparted to said draft gear during its operation. The spring assembly is configured to function in operable combination with the of the first and second sliding surfaces relative to the longitudinal axis of the draft gear such that said draft gear consistently and repeatedly withstands about 130 KJ of energy imparted to the draft gear at a force level of about three meganewtons over a range of travel of the wedge member in an inward axial direction relative to the housing not exceeding about 120 mm.

In one form, each individual unit of the elastomeric spring assembly further includes a pair of metal plates which, when arranged in the draft gear housing, are disposed generally normal to the longitudinal axis of the draft gear and to opposed sides of the elastomeric spring. Preferably, each metal plate has generally rectangular configuration, in plan.

At least one sidewall of the draft gear housing preferably defines an opening through which the individual units of the spring assembly can be moved into the chamber defined by the housing. In a preferred form, the angle θ of the first friction surface defined by each friction member and the draft gear housing ranges between about 1.7° and about 2° relative to the longitudinal axis of the draft gear. Moreover, the angle β of the second friction surface defined between each outer tapered surface on the wedge member and the inner surface on each friction member of the friction clutch assembly preferably ranges between about 32° and about 45° relative to the longitudinal axis of the draft gear. In one form, each friction member further includes structure arranged in operable combination with the spring seat for maintaining the friction members in operational relation relative to the wedge during operation of the draft gear.

Preferably, the elastomeric spring of each individual unit of the spring assembly is formed from a polyester material having a Shore D hardness ranging between about 40 and 60 and an elastic strain to plastic strain ratio greater than 1.5 to 1. Moreover, each metal plate of each individual unit of the elastomeric spring assembly preferably includes structure interengaging with similar structure of an adjacent unit of the elastomeric spring assembly for maintaining the individual units in generally aligned and stacked relation relative to each other.

According to yet another aspect, there is provided a friction/elastomeric draft gear for a railcar including a metallic housing having a closed end and an open end aligned relative to each other along a longitudinal axis. The housing has a hollow chamber defined by two pairs of generally parallel and joined walls so as to provide the chamber with a generally rectangular cross-section extending from the closed end toward the open end. A series of tapered friction surfaces extend from the open end toward the closed end of the housing. A series of equally spaced friction members are slidably arranged in the open end of the housing. An outer angled surface on each friction member is operably associated with a tapered friction surface on the housing so as to define a first friction sliding surface therebetween. A wedge member, having a free end extending beyond the open end of the housing, also has a plurality of outer angled friction surfaces engagable with inner angled surfaces on the friction members and is adapted to actuate same upon movement thereof inwardly of the housing. A second friction sliding surface is defined between the outer friction surfaces on the wedge member and the inner angled surfaces on the friction members.

An elastomeric spring assembly is centered and slidably fitted within the rectangular hollow chamber of the housing and is comprised of a series of axially stacked individual units disposed between the closed end of the housing for resisting inward movement of the wedge member during operation of the draft gear. One end of the spring assembly is disposed against the closed end of the housing. A second end of the spring assembly urges a spring seat, disposed generally normal to the longitudinal axis of the draft gear, against one end of the friction members. Each unit of the spring assembly includes a an elastomeric spring, having, in plan, a generally rectangular configuration approximating the cross-sectional configuration of the hollow chamber of said housing whereby optimizing the capability of the spring assembly to store, dissipate and return energy imparted to said draft gear during its operation. The spring assembly is configured to function in operable combination with the disposition of the first and second angled friction surfaces relative to the longitudinal axis of the draft gear such that said draft gear consistently and repeatedly withstands between about 100 KJ and about 130 KJ of energy imparted to the draft gear while not exceeding a force level of three meganewtons and over a range of travel of the wedge member in an inward axial direction relative to the housing ranging between about 90 mm and about 120 mm.

In one form, each individual unit of the elastomeric spring assembly further includes a pair of metal plates which, when arranged in the draft gear housing, are disposed generally normal to the longitudinal axis of the draft gear and to opposed sides of the elastomeric spring. Preferably, each metal plate has generally rectangular configuration, in plan.

To facilitate assembly of the draft gear, at least one wall of the draft gear housing preferably defines an opening through which the units comprising the spring assembly can be moved into the hollow chamber defined by the housing. Preferably, the first friction sliding surface, between each friction member and the draft gear housing, is disposed at an angle ranging between about 1.7° and about 2° relative to the draft gear longitudinal axis. In a preferred form, the second friction sliding surface, between the outer friction surfaces on the wedge member and the inner angled surfaces on the friction members, is disposed at an angle ranging between about 32° and about 45° relative to the draft gear longitudinal axis. Each friction member furthermore preferably includes structure arranged in operable combination with the spring seat for maintaining each friction member in proper relation relative to the wedge during operation of the draft gear.

The elastomeric spring of each individual unit of the spring assembly is preferably formed from a polyester material having a Shore D hardness ranging between about 40 and 60 and an elastic strain to plastic strain ratio greater than 1.5 to 1. Moreover, the metal plate of each individual unit of the spring assembly preferably includes structure interengaging with similar structure of an adjacent individual unit for maintaining the individual elastomeric springs in generally aligned and stacked relation relative to each other.

DESCRIPTION OF THE DRAWINGS

FIG. 6 is a partial sectional view of an spring unit forming part of an axially elongated elastomeric spring assembly for the draft gear and taken along line 6-6 of FIG. 2;

FIG. 7 is a top plan view of one form of an individual spring unit forming part of the elastomeric spring assembly partially shown in FIG. 6;

DETAILED DESCRIPTION

Figure 1:
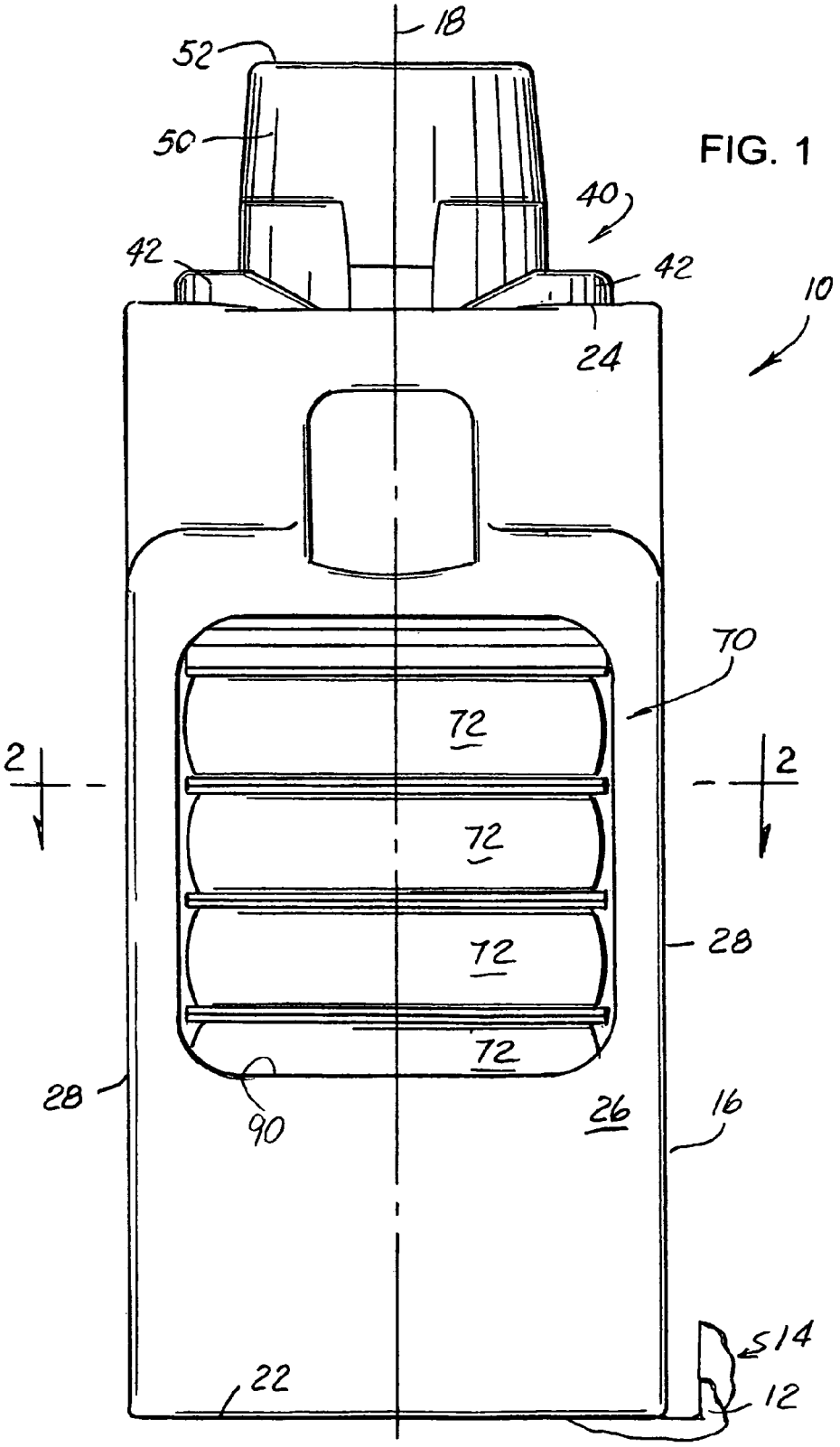
FIG. 1 is a side elevational view of one form of a draft gear embodying both features and principals of this invention disclosure.

While this invention disclosure is susceptible of embodiment in multiple forms, there is shown in the drawings and will hereinafter be described a preferred embodiment, with the understanding the present disclosure sets forth an exemplification of the disclosure which is not intended to limit the disclosure to the specific embodiment illustrated and described.

Figure 2:
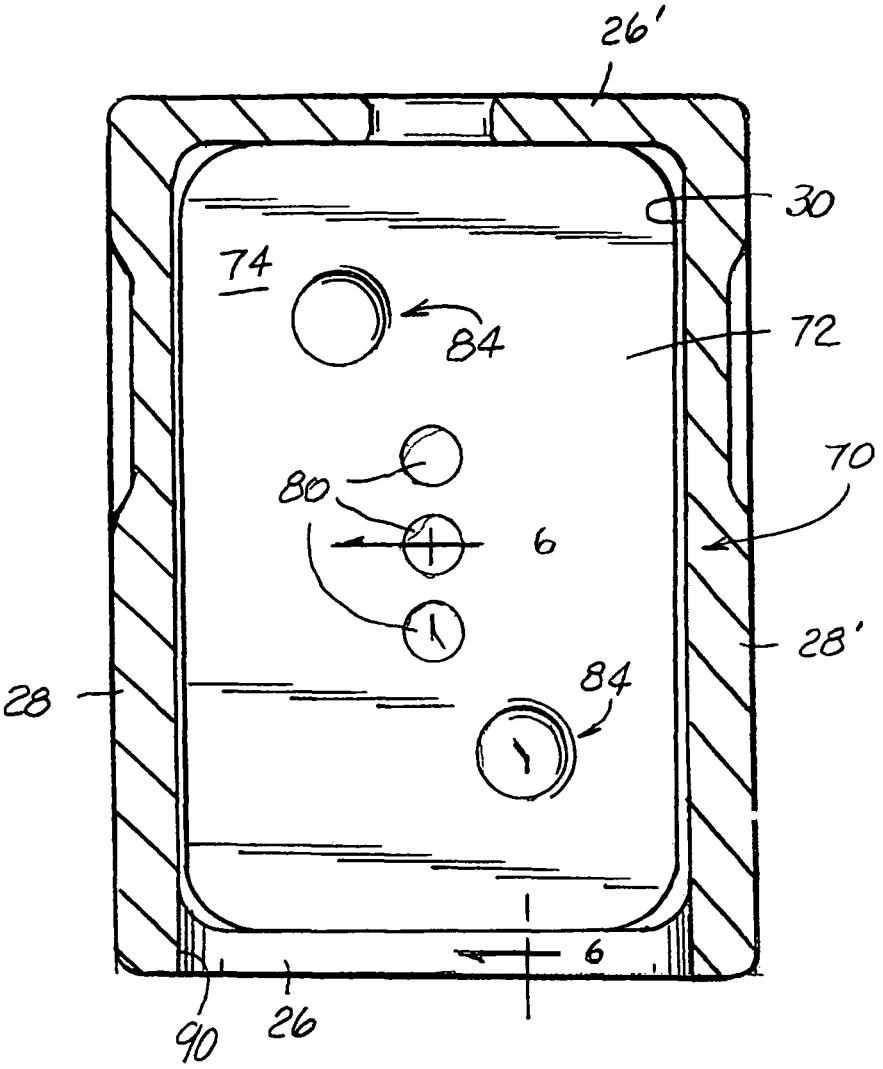
FIG. 2 is a sectional view taken along line 2-2 of FIG. 1.
Figure 3:
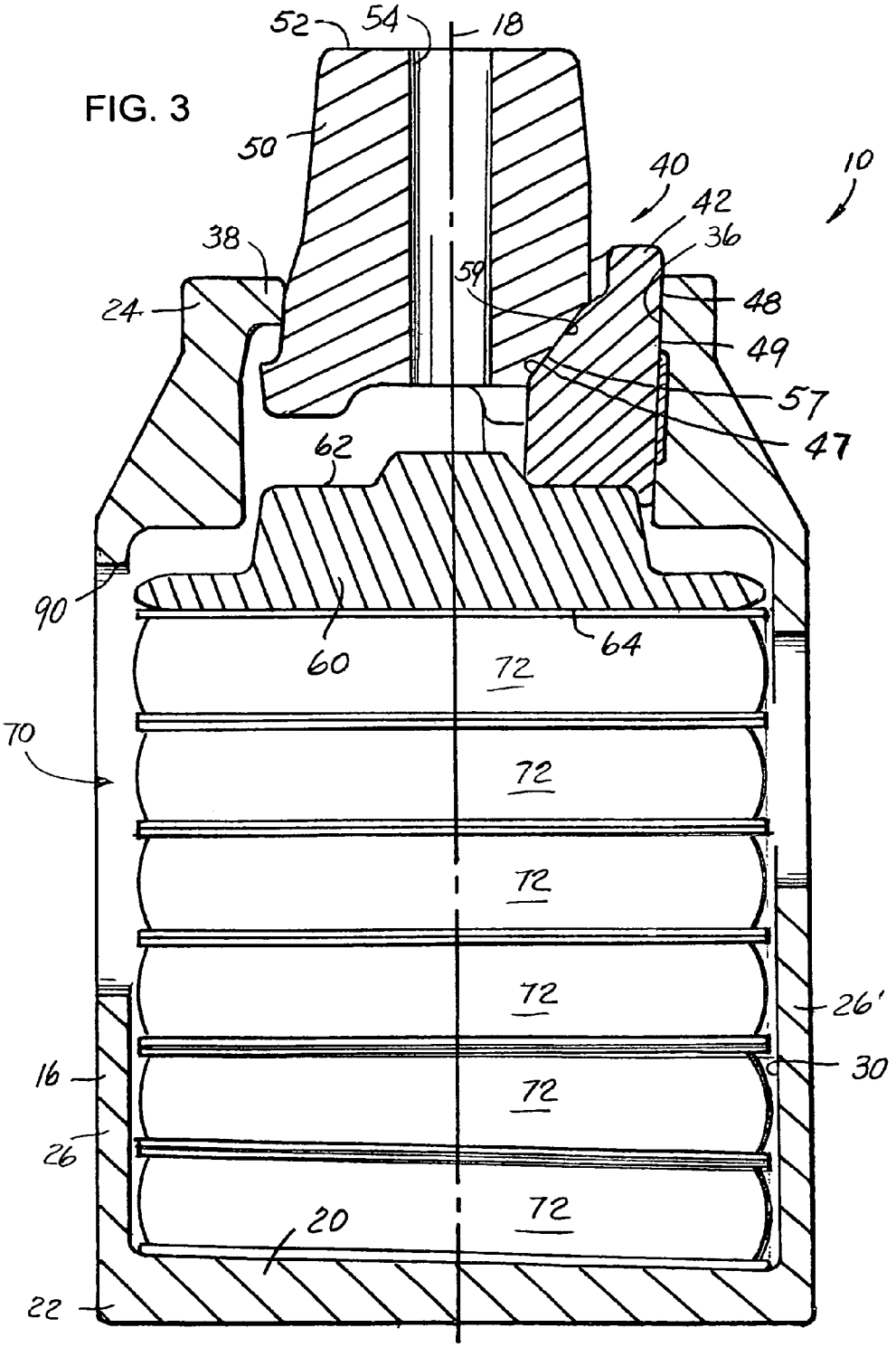
FIG. 3 is a longitudinal vertical sectional view of the draft gear illustrated in FIG. 1.

Referring now to the drawings, wherein like reference numerals indicate like parts throughout the several views, there is shown in FIG. 1 a railroad car draft gear, generally indicated by reference numeral 10, adapted to be carried within a yoke 12 arranged in operable combination with a centersill (not shown) of a railcar 14. As used herein and throughout, the term "railcar" is meant to include different types and designs of railcars including, but not limited to, railroad hopper cars, railroad freight cars, railroad tank cars, and etc. Draft gear 10 includes an axially elongated hollow and metallic housing 16 defining a longitudinal axis 18 for the draft gear 10. Housing 16 is closed by an end wall 20 (FIG. 3) at a first or closed end 22 and is open toward an axially aligned second or open end 24. Housing 16 includes two pairs of joined and generally parallel walls 26, 26' and 28, 28' (FIG. 2), extending from the closed end 22 toward the open end 24 and defining a hollow chamber 30 within housing 16 (FIGS. 2 and 3). As shown in FIG. 2, the housing walls 26, 26' and 28, 28' provide the housing chamber 30 with a generally rectangular or boxlike cross-sectional configuration for a major lengthwise portion thereof.

Moreover, and as shown in FIG. 3, housing 16 is provided with a plurality (with only one being shown in FIG. 3) of equi-angularly spaced and longitudinally extended tapered inner angled friction surfaces 36. The tapered inner angled friction surface 36 on housing 16 converges toward the longitudinal axis 18 and toward the closed end 22 of the draft gear housing 16. Preferably, housing 16 is provided with three equally spaced longitudinally extended and tapered inner angled friction surfaces 36 but more tapered surfaces could be provided without detracting or departing from the spirit and novel concept of this invention disclosure.

In the embodiment shown in FIG. 3, draft gear 10 is also provided with a friction clutch assembly 40 for absorbing draft forces or impacts axially directed against the draft gear 10. In the embodiment shown in FIG. 3, the friction clutch assembly 40 includes a plurality of friction members or shoes 42 arranged about axis 18 and in operable combination with the open end of the draft gear housing 16. As shown by way of example in FIG. 4, the friction clutch assembly 40 can be provided with three equi-angularly spaced friction members 42 but more friction members could be provided without detracting or departing from the spirit and novel concept of this invention disclosure. Suffice it to say, in the embodiment shown by way of example in FIGS. 1, 3 and 4, the number of friction members 42 forming part of the friction clutch assembly 40 are equal in number to the number of tapered inner angled friction surfaces 36 on housing 16.

Figure 5:
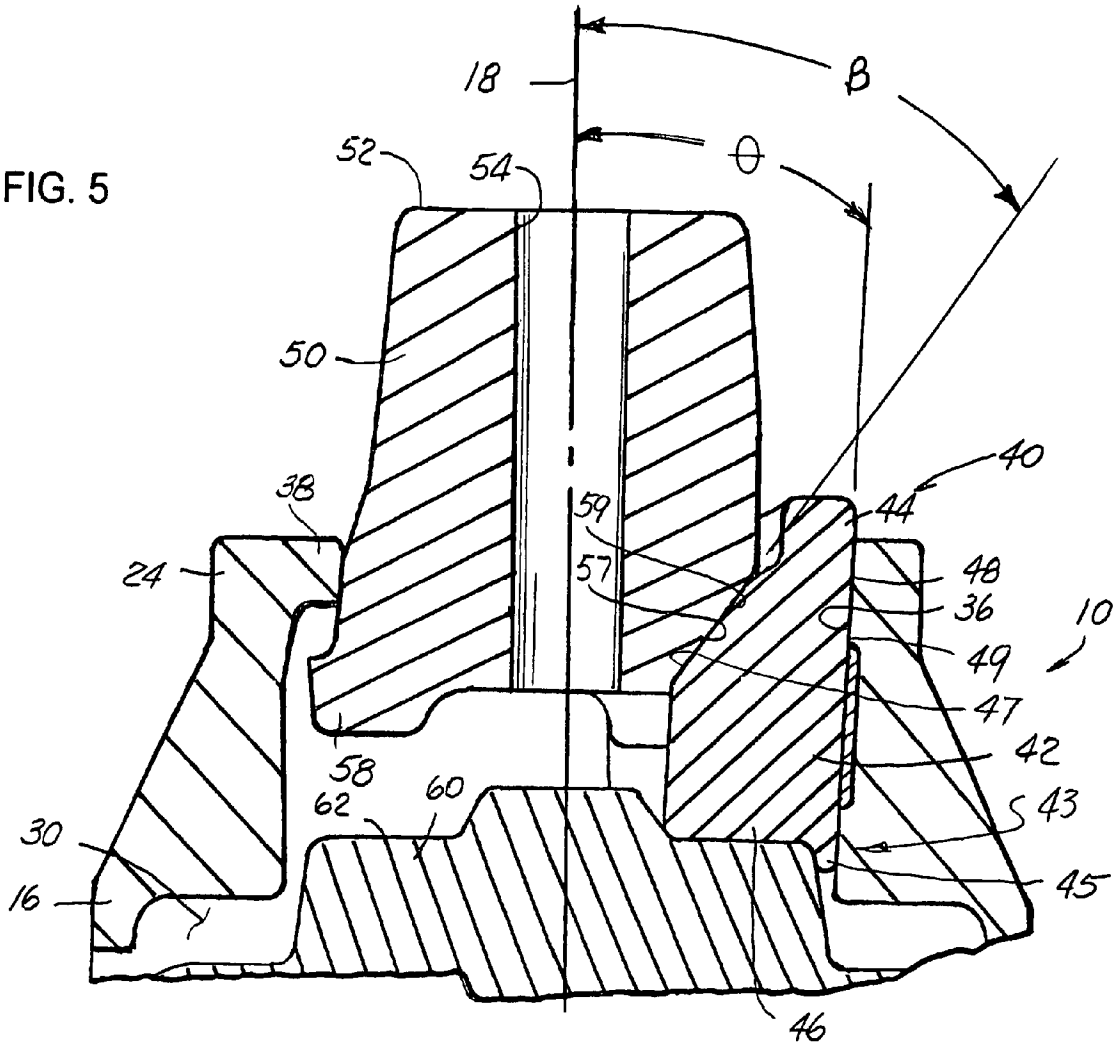
FIG. 5 is an enlarged sectional view of one end of the draft gear illustrated in FIG. 3

Turning to FIG. 5, each friction member 42 has axially or longitudinally spaced first and second end 44 and 46. Moreover, each friction member 42 has an outer or external tapered sliding surface 48. When the draft gear 10 is assembled, each inner angled friction surface 36 on housing 16 combines with each outer tapered sliding surface 48 on each friction member to define a first angled friction sliding surface 49 therebetween. The first friction sliding surface 49 is disposed at an angle θ relative to the longitudinal axis 18 of the draft gear assembly 10. Preferably, the angle θ of the first friction sliding surface 49 ranges between about 1.7 degrees and about 2 degrees relative to the longitudinal axis 18 of the draft gear 10.

In the illustrated embodiment, the friction clutch assembly 40 further includes a wedge member or actuator 50 arranged for axial movement relative to the open end 24 of housing 16. As shown in FIGS. 1, 3 and 5, an outer end 52 of the wedge member 50 preferably has a generally flat face and that extends beyond the open end 24 of housing 16 for a distance measuring about 120 mm and is adapted to bear on the usual follower (not shown) of a railway draft rigging such that draft or impact forces can be axially applied to the draft gear 10 during operation of the railcar 10. As known, wedge member 50 is arranged in operable combination with the friction members 42.

The wedge member or actuator 50 defines a plurality of outer tapered or angled friction surfaces 57 arranged in operable combination with the friction members 42 of the clutch assembly 40. Although only one friction surface 57 is shown in FIG. 5, the number of friction surfaces 57 on the wedge member 50 equals the number of fiction members 42 used as part of the friction clutch assembly 40. When the draft gear 10 is assembled, each outer angled friction surface 57 on wedge member 50 combines with an inner angled sliding surface 47 on each friction member to define a second angled friction sliding surface 59 therebetween. The second friction sliding surface 59 is disposed at an angle β relative to the longitudinal axis 18 of the draft gear 10. Preferably, the angle β of the second friction sliding surface 59 of friction clutch assembly 40 ranges between about 32 degrees and about 45 degrees relative to the longitudinal axis 18 of the draft gear 10.

Wedge member 50 is formed from any suitable metallic material. In a preferred form, wedge member 50 is formed from an austempered ductile iron material. Moreover, and as shown in FIGS. 1 and 5, the wedge member or actuator 50 defines a generally centralized longitudinally extending bore 54.

Figure 4:
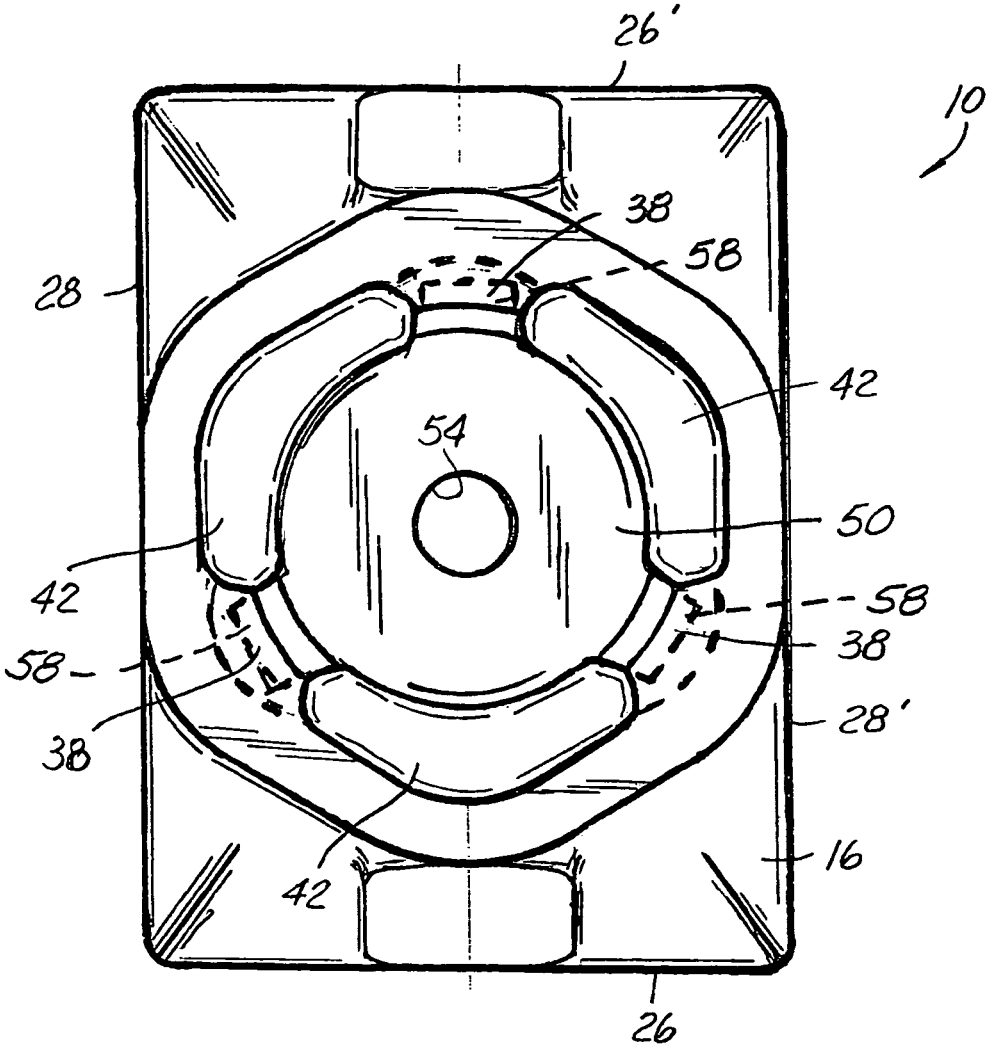
FIG. 4 is a top plan view of the draft gear illustrated in FIG. 1.

As shown in FIGS. 3, 4 and 5, at its open end 20, housing 16 is provided with a series of radially inturned stop lugs 38 which are equi-angularly spaced circumferentially relative to each other. Toward a rear end thereof, wedge member 50 includes a series of radially outwardly projecting lugs 58 which are equi-angularly disposed relative to each other and extend between adjacent friction members 42 so as to operably engage in back of the lugs 38 on housing 16 and facilitate assembly of the draft gear 10.

As shown in FIG. 3, draft gear 10 furthermore includes a spring seat or follower 60 arranged within the hollow chamber 30 of housing 16 and disposed generally normal or generally perpendicular to the longitudinal axis 18 of the draft gear 10. Spring seat 60 is adapted for reciprocatory longitudinal or axial movements within the chamber 30 of housing 16 and has a first surface 62 in operable association with the second or rear end 46 of each friction member 42. Spring seat 60 also has a second or spring contacting surface 64.

In the form shown by way of example in FIG. 5, each friction member 42 of clutch assembly 40 furthermore includes structure 43 arranged in operable combination with the spring seat 60 for maintaining each friction member 42 in proper disposition and relation relative to the wedge 50 during operation of the draft gear 10. In the form shown in FIG. 5, such structure includes a guide 45 arranged in depending relation from the second or lower end 46 of each friction member 42. As shown, the guide 45 on each friction member 42 is slidably entrapped between the draft gear housing 16 and spring seat 60 whereby maintaining each friction member 42 in proper disposition and relation relative to the wedge 50 as the friction members 42 move in the housing 16 in response to axial movements of wedge 50 during operation of the draft gear 10.

An axially elongated elastomeric spring assembly 70 is generally centered and slidable within chamber 30 of the draft gear housing 16 and forms a resilient column for storing dissipating and returning energy imparted or applied to the free end 52 of wedge member 50 during axial compression of the draft gear 10. One end of spring assembly 70 is arranged in contacting relation with the end wall 20 of housing 16. A second end of spring assembly 70 is pressed or urged against surface 64 of the spring seat 60 to oppose inward movements of the friction members 42 and wedge member 50. As known, spring assembly 70 is precompressed during assembly of the draft gear 10 and serves to maintain the components of the friction clutch assembly 40, including friction members 42 and wedge member 50, k in operable combination relative to each other and within the draft gear housing 16 both during operation of the draft gear 10 as well as during periods of non-operation of the draft gear 10. In the illustrated embodiment, spring assembly 70 develops about a 10,000 pound preload force for the draft gear 10 and in combination with the friction clutch assembly 40 is capable of absorbing, dissipating and returning impacts or energy directed axially thereto in the range of between 450,000 lbs. and about 700,000 lbs.

In the form shown in FIG. 3, spring assembly 70 is comprised of a plurality of individual units or springs 72 arranged in axially stacked relationship relative to each other. In the form shown in FIG. 6, each cushioning unit or spring 72 includes a pair of substantially rectangular metal plates 74 and 76 and an elastomeric pad or spring 78 also having a generally rectangular shape so as to optimize the rectangular area of the hollow chamber 30 (FIG. 3) wherein spring assembly 70 is slidably centered for axial endwise movements in response to loads or impacts being exerted axially against the draft gear 10 (FIG. 1). Preferably, the elastomeric pad or spring 78 is configured such that its radial expansion, in response to loads being placed thereon, is limited whereby preventing the pad 78 from squeezing outwardly so far beyond the edges of the plates 74, 76 as to significantly damage or have its performance significantly effected.

As illustrated in FIG. 6, opposed generally planar surfaces 79 and 79' of the elastomeric pad or spring 78 are each preferably secured to and between each of the metal plates 74, 76 as a result of a working process and methodology of the type disclosed in detail in U.S. Pat. No. 5,381,844 to R. A. Carlstedt; applicable portions of which are incorporated herein by reference.

Preferably, the elastomeric pad 78 is formed from a polyester material having a Shore D hardness ranging between about 40 and 60 and an elastic strain to plastic strain ratio of about 1.5 to 1. Suffice it to say, and as described in greater detail in U.S. Pat. No. 5,381,844 to R. A. Carlstedt, the working process and methodology for creating the each spring unit 72 involves creating a preform block which is arranged between the plates 74, 76. The preform block of elastomer along with the plates 74, 76 are precompressed to greater than 30% of the preformed height of the preform thereby transmuting the preform into an elastomeric spring.

The plates 74, 76 are preferably of similar design to advantageously reduce the manufacturing cost for each spring unit 72. In the preferred embodiment, each plate 74, 76 has one or more openings or throughbores 80 arranged in generally centered relation thereon. During the working process described above for each unit 72, elastomeric material of the preform tends to flow into and engage with the marginal edge of each bore 80 whereby enhancing securement of the pad 78 to each plate 74, 76.

Preferably, the plates 74, 76 of each elastomeric spring unit 72 further includes structure 84 interengaging with similar structure on an adjacent elastomeric spring unit 72 for maintaining the individual elastomeric springs in generally aligned and stacked relationship relative to each other. In the form shown in FIG. 6, the plates 74, 76 preferably include projections 86 extending from one side and seats 88 on the opposite side; with the projections 86 and seats 88 being arranged in aligned sets. In one form, the projection 86 and seat 88 of each set is provided by an embossed hollow projection on the respective plates 74, 76 of each unit 72.

As shown in FIGS. 1 and 2, a relatively large rectangular opening 90 is preferably formed in wall 26 of the draft gear housing 16. Opening 90 is sized such that one or more of the spring units 72 can be inserted through the opening 90 in a direction extending generally normal to the longitudinal axis 18 of the draft gear and into the hollow chamber 30 of housing 16. Moreover, and in the preferred form shown in FIG. 3, the end wall 20 is provided with a slight angle or slope of about 1.25° in a direction extending away from the opening 90 in the housing 16.

Figure 8:
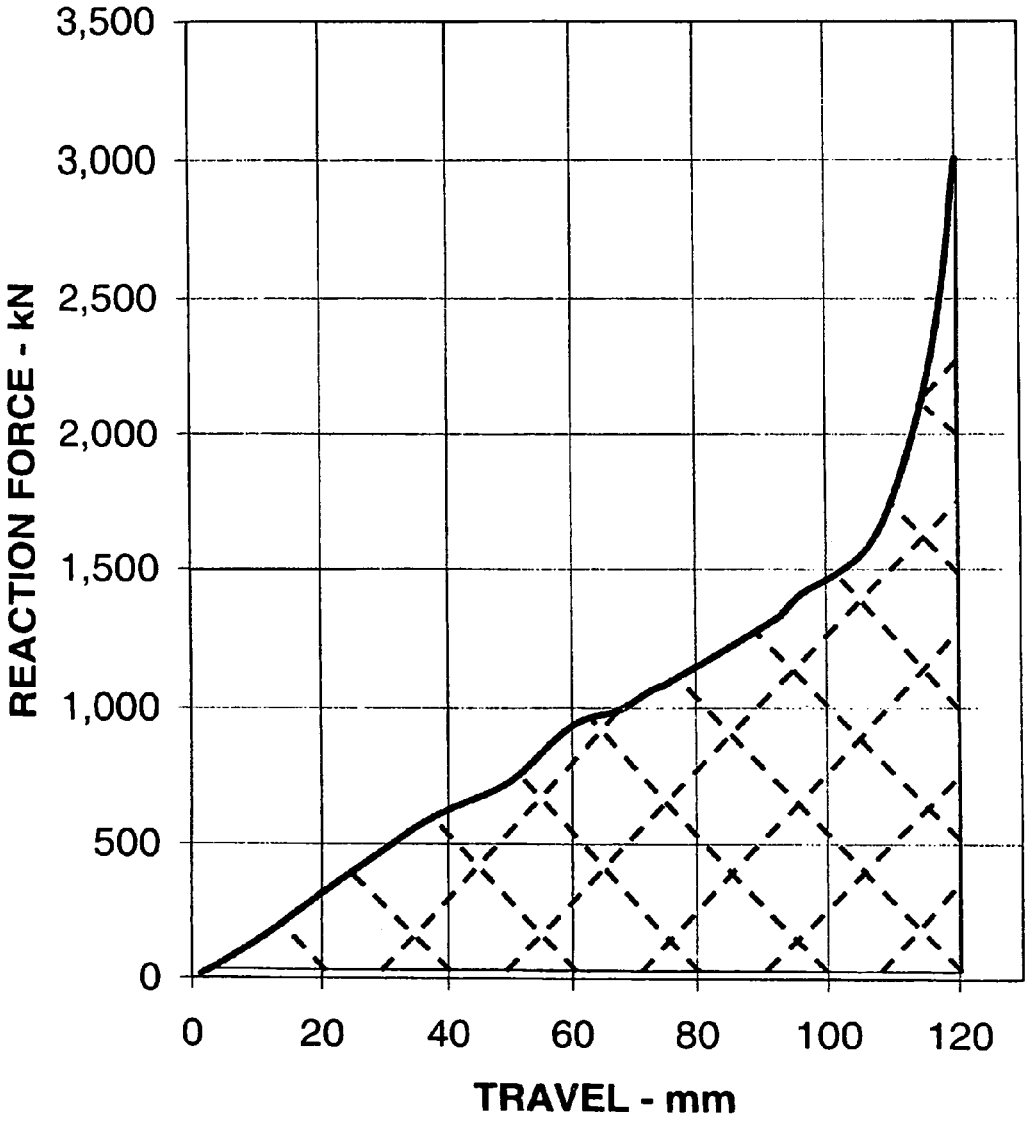
FIG. 8 is a schematic representation of the performance of the draft gear embodying principals and teachings of this invention disclosure.

FIG. 8 schematically illustrates performance criteria of a draft gear embodying principals and teachings of this invention disclosure. In one, example, the spring assembly 70

Figure 9:
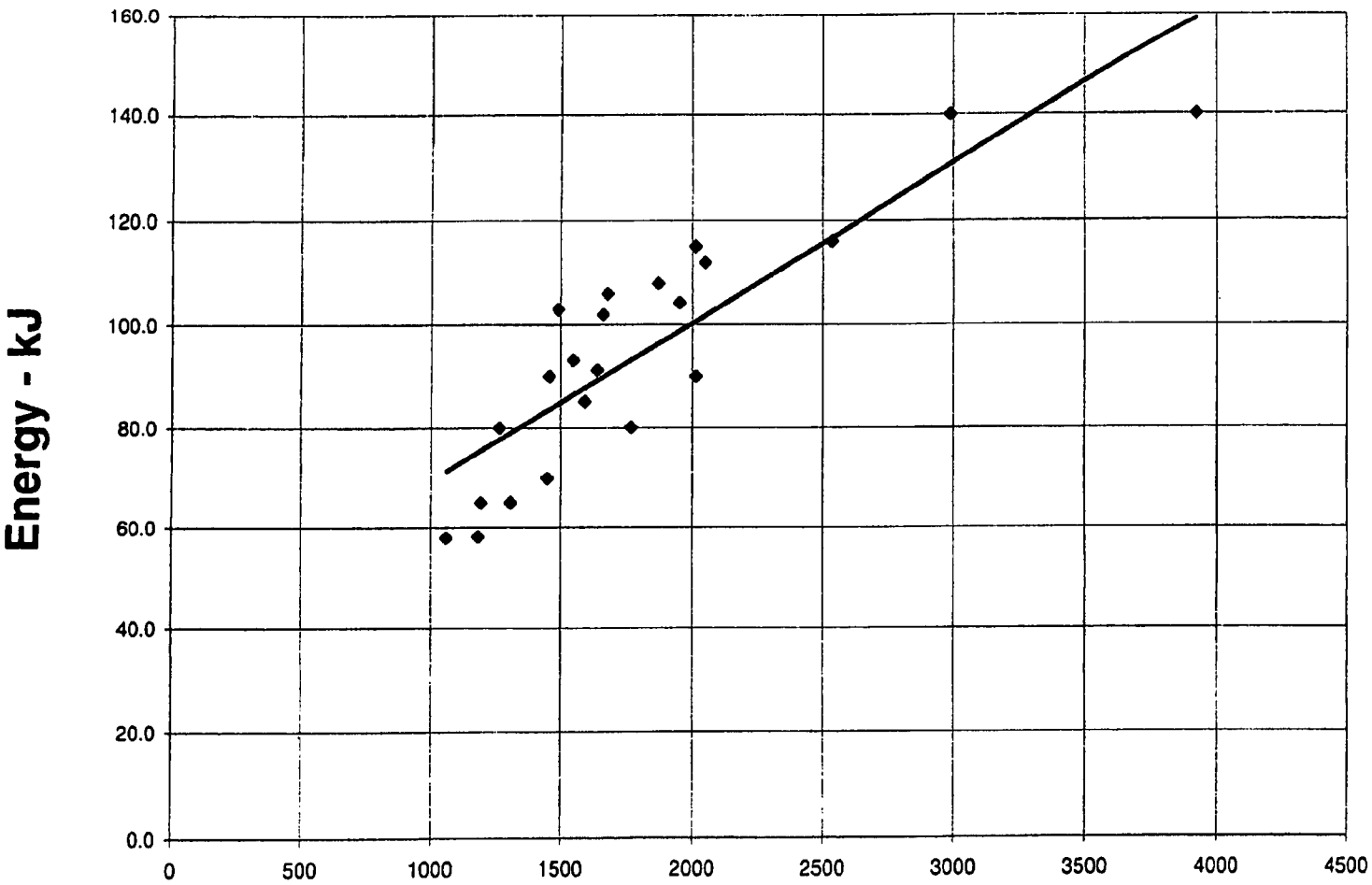
FIG. 9 is a schematic representation of testing results for multiple impacts on a draft gear embodying principals and teachings of this invention disclosure.

(FIGS. 3 and 5) is configured to function in operable combination with the angles θ and β of the first and second friction sliding surfaces 49 and 59 (FIG. 5), respectively, relative to the longitudinal axis 18 such that the draft gear 10 consistently and repeatedly withstands 100 KJ of energy imparted thereto while not exceeding a force level of two meganewtons over a range of travel of the wedge member 50 in an inward axial direction relative to the draft gear housing 18 of about 90 mm. Alternatively, the spring assembly 70 (FIGS. 3 and 5) is configured to function in operable combination with the angles θ and β of the first and second friction sliding surfaces 49 and 59 (FIG. 5), respectively, relative to the longitudinal axis 18 such that the draft gear 10 consistently and repeatedly withstands about 130 KJ of energy imparted thereto at a force level of about three meganewtons over a range of travel of the wedge member 50 in an inward axial direction relative to the draft gear housing 18 not exceeding 120 mm. In another example, the spring assembly 70 (FIGS. 3 and 5) is configured to function in operable combination with the angles θ and β of the first and second friction sliding surfaces 49 and 59, respectively, relative to the longitudinal axis 18 such that the draft gear 10 consistently and repeatedly withstands between about 100 KJ and 130 KJ of energy imparted to said draft gear while not exceeding a force level of three meganewtons over a range of travel of the wedge member 50 in an inward axial direction relative to the draft gear housing 18 ranging between about 90 mm and about 120 mm. FIG. 9 schematically represents multiple impacts directed against the draft gear 10.

From the foregoing, it will be observed that numerous modifications and variations can be made and effected without departing or detracting from the true spirit and novel concept of this invention disclosure. Moreover, it will be appreciated, the present disclosure is intended to set forth an exemplification which is riot intended to limit the disclosure to the specific embodiment illustrated. Rather, this disclosure is intended to cover by the appended claims all such modifications and variations as fall within the spirit and scope of the claims.

What is claimed is:

1. A friction/elastomeric draft gear, comprising:

a hollow metal housing open at a first end and closed toward the second end thereof, said housing defining a longitudinal axis for said draft gear and has a series of tapered longitudinally extended inner surfaces opening to and extending from the first end of said housing, and wherein said housing has two pairs of joined and generally parallel walls extending from the closed second end toward the first end such that said walls define a hollow chamber having a generally rectangular cross-sectional configuration for a major portion of the length thereof and which opens to the open end of said housing;

a series of friction members equally spaced about the longitudinal axis of said housing at the first end of said housing, with each friction member having axially spaced first and second ends and an outer surface extending between said ends, with the outer surface on each friction member being operably associated with one of said tapered longitudinally extended inner surfaces on said housing so as to define a first angled friction sliding surface therebetween;

a wedge member arranged for axial movement relative to the first end of said housing and against which an external force can be applied, said wedge member defining a series of outer tapered surfaces equally spaced about the longitudinal axis of said housing and equal in number to the number of friction members, with each outer tapered surface on said wedge member being operably associated with an inner surface on each friction member so as to define a second angled friction sliding surface therebetween and such that said wedge member produces a radially directed force against said friction members upon movement of said wedge member inwardly of the housing;

a spring seat arranged within the hollow chamber, with one surface of said spring seat being arranged in operable engagement with the second end of each friction member;

a spring assembly disposed in the hollow chamber between the closed end of said housing and a second surface of said spring seat for storing, dissipating and returning energy imparted to said draft gear, with said spring assembly comprising a axial stack of individual elastomeric springs, with each individual elastomeric spring including an elastomeric pad having a generally rectangular shape, in plan, approximating the cross-sectional configuration of the hollow chamber of said housing whereby optimizing the capability of said spring assembly to store, dissipate and return energy imparted to said draft gear during its operation; and with said spring assembly being configured to function in operable combination with the disposition of said first and second angled sliding surfaces relative to the longitudinal axis of said draft gear such that said draft gear consistently and repeatedly withstands 100 KJ of energy imparted to said draft gear while not exceeding a force level of two meganewtons over a range of travel of said wedge member in an inward axial direction relative to said housing greater than about 90 mm.

2. The friction/elastomeric draft gear according to claim 1, wherein at least one wall of said housing defines an opening through which said elastomeric springs can be moved into the hollow chamber defined by said housing.

3. The friction/elastomeric draft gear according to claim 1, wherein the first angled friction sliding surface is disposed at an angle ranging between about 1.7 degrees and about 2 degrees relative to the longitudinal axis of said draft gear.

4. The friction/elastomeric draft gear according to claim 1, wherein the second angled friction sliding surface is disposed at an angle ranging between about 32 degrees and about 45 degrees relative to the longitudinal axis of said draft gear.

5. The friction/elastomeric draft gear according to claim 1, wherein each friction member further includes structure arranged in operable combination with said spring seat for maintaining each friction member in proper relation relative to said wedge during operation of said draft gear.

6. The friction/elastomeric draft gear according to claim 1, wherein the elastomeric pad of each individual elastomeric spring is formed from a polyester material having a Shore D hardness ranging between about 40 and 60 and an elastic strain to plastic strain ratio greater than 1.5 to 1.

7. The friction/elastomeric draft gear according to claim 6, wherein each elastomeric pad of each individual elastomeric spring further includes a metal plate on opposed planar sides of said elastomeric pad.

8. The friction/elastomeric draft gear according to claim 7, wherein each metal plate includes structure interengaging with similar structure of an adjacent elastomeric spring for maintaining the individual elastomeric springs in generally aligned and stacked relation relative to each other.

9. The friction/elastomeric draft gear according to claim 1, wherein the elastomeric spring of each individual unit of said elastomeric spring assembly is formed from a polyester material having a Shore D hardness ranging between about 40 and 60 and an elastic strain to plastic strain ratio greater than 1.5 to 1.

10. The friction/elastomeric draft gear according to claim 1, wherein each individual elastomeric spring includes structure for maintaining axially adjacent elastomeric pads of the spring assembly in generally axially aligned relation relative to each other.

11. A friction/elastomeric draft gear for a railcar, comprising:

an axially elongated metallic housing having a closed end, an open end and a longitudinal axis extending between said ends, with said housing further including two pairs of joined sidewalls extending generally from said closed end for major lengthwise distance between said ends so as to define a hollow chamber having a generally rectangular cross-sectional configuration;

a friction clutch assembly for absorbing axial impacts directed against one end of said draft gear, said friction clutch assembly including a plurality of friction members, with each friction member having an outer surface angled relative to said longitudinal axis and arranged in sliding friction engagement with the open end of said housing so as to define a first angled friction sliding surface disposed at an angle θ relative to the longitudinal axis of the draft gear, with said friction clutch assembly further including an actuator having a plurality of angled surfaces, with one end of said actuator axially extending beyond the open end of said housing for receiving energy directed axially to draft gear, and with each angled surface on said actuator being arranged in sliding friction engagement with an inner surface on each friction member so as to define a second angled friction sliding surface β relative to the longitudinal axis of the draft gear, and a spring seat arranged in operable combination with said plurality of friction members;

an elastomeric spring assembly centered and slidably fitted within the rectangular hollow chamber of said housing and comprised of a series of axially stacked individual units disposed between the closed end of said housing and said spring seat for absorbing, dissipating and returning energy imparted to said actuator during operation of said draft gear, with each unit including an elastomeric spring, having, in plan, a generally rectangular configuration approximating the cross-sectional configuration of the hollow chamber of said housing whereby optimizing the capability of said spring assembly to store, dissipate and return energy imparted to said draft gear during its operation; and with said spring assembly being configured to function in operable combination with the angle of said first and second sliding surfaces relative to the longitudinal axis of said draft gear such that said draft gear consistently and repeatedly withstands about 130 KJ of energy imparted to said draft gear at a force level of about three meganewtons over a range of travel of said wedge member in an inward axial direction relative to said housing not exceeding about 120 mm.

12. The friction/elastomeric draft gear according to claim 11, wherein at least one sidewall of said housing defines an opening through which said elastomeric springs can be moved into the hollow chamber defined by said housing.

13. The friction/elastomeric draft gear according to claim 11, wherein the angle θ of the first angled friction sliding surface ranges between about 1.7 degrees and about 2 degrees relative to the longitudinal axis of said draft gear.

14. The friction/elastomeric draft gear according to claim 11, wherein the angle θ of the second angled friction sliding surface β ranges between about 32 degrees and about 45 degrees relative to the longitudinal axis of said draft gear.

15. The friction/elastomeric draft gear according to claim 11, wherein each friction member of the friction clutch assembly further includes structure arranged in operable combination with said spring seat for maintaining each friction member in proper relation relative to said wedge during operation of said draft gear.

16. The friction/elastomeric draft gear according to claim 11, wherein each individual unit of said elastomeric spring assembly further includes a pair of metal plates disposed generally normal to said longitudinal axis of the draft gear and to opposed sides of said elastomeric spring, with each metal plate having a generally rectangular configuration, in plan.

17. The friction/elastomeric draft gear according to claim 16, wherein each metal plate of each individual unit of said elastomeric spring assembly includes structure interengaging with similar structure of an adjacent unit of said elastomeric spring assembly for maintaining the individual units in generally aligned and stacked relation relative to each other.

18. A friction/elastomeric draft gear for a railcar, comprising:

a metallic housing having a closed end and an open end aligned relative to each other along a longitudinal axis, with said housing defining a hollow chamber defined by two pairs of generally parallel and joined walls so as to provide said chamber with a generally rectangular cross-section extending from the closed end toward the open end, and series of tapered friction surfaces extending from the open end toward the closed end of said housing;

a series of equally spaced friction members arranged in the open end of said housing, with an outer angled surface on each friction member being operably associated with a friction surface on said housing so as to define a first angled friction sliding surface therebetween;

a wedge member having a free end extending beyond the open end of said housing, with said wedge member having a plurality of friction surfaces engagable with inner angled surfaces on said friction members and adapted to actuate same upon movement thereof inwardly of said housing, with a second angled friction sliding surface being defined between the friction surfaces on said wedge member and the inner angled surfaces said friction members;

an elastomeric spring assembly centered and slidably fitted within the rectangular hollow chamber of said housing and comprised of a series of axially stacked individual units disposed between the closed end of said housing for resisting inward movement of said wedge member during operation of said draft gear, with one end of said spring assembly being disposed against said closed end of said housing, and with a second end of said spring assembly urging a spring seat, disposed generally normal to the longitudinal axis of said draft gear, against one end of each friction member, and with each unit including an elastomeric spring, having, in plan, a generally rectangular configuration approximating the cross-sectional configuration of the hollow chamber of said housing whereby optimizing the capability of said spring assembly to store, dissipate and return energy imparted to said draft gear during its operation; and with said spring assembly being configured to function in operable combination with the disposition of said first and second angled friction sliding surfaces relative to the longitudinal axis of said draft gear such that said draft gear consistently and repeatedly withstands between about 100 KJ and about 130 KJ of energy imparted to said draft gear while not exceeding a force level of three meganewtons and over a range of travel of said wedge member in an inward axial direction relative to said housing ranging between about 90 mm and about 120 mm.

19. The friction/elastomeric draft gear according to claim 18, wherein at least one wall of said housing defines an opening through which said elastomeric springs can be moved into the hollow chamber defined by said housing.

20. The friction/elastomeric draft gear according to claim 18, wherein the first angled friction sliding surface is disposed at an angle ranging between about 1.7 degrees and about 2 degrees relative to the longitudinal axis of said draft gear.

21. The friction/elastomeric draft gear according to claim 18, wherein the second angled friction sliding surface is disposed at an angle ranging between about 32 degrees and about 45 degrees relative to the longitudinal axis of said draft gear.

22. The friction/elastomeric draft gear according to claim 18, wherein each friction member further includes structure arranged in operable combination with said spring seat for maintaining each friction member in proper relation relative to said wedge during operation of said draft gear.

23. The friction/elastomeric draft gear according to claim 18, wherein the elastomeric spring of each individual unit of said spring assembly is formed from a polyester material having a Shore D hardness ranging between about 40 and 60 and an elastic strain to plastic strain ratio greater than 1.5 to 1.

24. The friction/elastomeric draft gear according to claim 18, wherein each individual unit of said elastomeric spring assembly further includes a pair of metal plates disposed generally normal to said longitudinal axis of the draft gear and to opposed sides of said elastomreic spring, with each metal plate having a generally rectangular configuration, in plan.

25. The friction/elastomeric draft gear according to claim 24, wherein the metal plate of each individual unit of said spring assembly includes structure interengaging with similar structure of an adjacent individual unit for maintaining the individual elastomeric springs in generally aligned and stacked relation relative to each other.

* * * * *